US007854374B2

(12) United States Patent
Dudley

(10) Patent No.: US 7,854,374 B2
(45) Date of Patent: Dec. 21, 2010

(54) THEFT PREVENTATIVE MAILBOX WITH REAR RESIDENTIAL AND STORAGE VAULT DOOR AND REMOTE UNLOCKING ACTIVATION MECHANISM

(76) Inventor: Joseph H. Dudley, 1109 Chapel Creek Ct., Richardson, TX (US) 75080

( * ) Notice: Subject to any disclaimer, the term of this patent is extended or adjusted under 35 U.S.C. 154(b) by 264 days.

(21) Appl. No.: 12/218,920

(22) Filed: Jul. 18, 2008

(65) Prior Publication Data

US 2009/0084836 A1 Apr. 2, 2009

Related U.S. Application Data

(60) Provisional application No. 60/995,606, filed on Sep. 28, 2007.

(51) Int. Cl.
*B65G 11/04* (2006.01)

(52) U.S. Cl. ..... 232/45; 232/17; 232/47; 340/5.73

(58) Field of Classification Search ..... 232/47, 232/48, 45, 17, 19, 34, 43.4; 340/569, 568.1, 340/5.73, 5.7, 5.61, 5.64, 5.66; 70/158–160
See application file for complete search history.

(56) References Cited

U.S. PATENT DOCUMENTS 6,375,071 B1 * 4/2002 Kim ..... 232/47
6,483,433 B2 * 11/2002 Moskowitz et al. ..... 340/568.1
6,533,167 B2 * 3/2003 Hassan ..... 232/45
6,957,767 B2 * 10/2005 Aupperle et al. ..... 232/45
7,025,249 B1 * 4/2006 Ledbetter ..... 232/34
7,036,719 B1 * 5/2006 Helphrey et al. ..... 232/47
7,249,705 B2 7/2007 Dudley
7,427,012 B2 * 9/2008 Saffel et al. ..... 232/45
2006/0214770 A1 * 9/2006 Capouch et al. ..... 340/5.73
2008/0012685 A1 * 1/2008 Friedrich et al. ..... 340/5.25
2008/0224875 A1 * 9/2008 Phillips et al. ..... 340/572.8

* cited by examiner

*Primary Examiner*—William L. Miller

(57) ABSTRACT

What is disclosed is a secure mailbox having at least an upper compartment with a plurality of sides, a front mailbox door hinge-ably coupled to a front edge of a side of the upper compartment, a locking and unlocking mechanism being adapted to lock the front mailbox door to the upper compartment and an unlocking activation mechanism coupled to the locking and unlocking mechanism; an upper rear mailbox door hinge-ably coupled to a rear edge of a side of the upper compartment, a locking and unlocking mechanism being adapted to lock the rear mailbox door to the upper compartment and an unlocking activation mechanism coupled to the locking and unlocking mechanism and a lower compartment having a lower, rear mailbox door hinge-ably coupled to a rear edge of a side of the lower compartment, at least one trap door being located between the upper compartment and lower compartment.

11 Claims, 3 Drawing Sheets

THEFT PREVENTATIVE MAILBOX WITH REAR RESIDENTIAL AND STORAGE VAULT DOOR AND REMOTE UNLOCKING ACTIVATION MECHANISM

CROSS REFERENCE TO RELATED APPLICATIONS

This application claims the benefit of U.S. Provisional Application No. 60/995,606 filed on Sep. 28, 2007, entitled "Theft Preventative Rear Residential Mailbox Door and a Rear Storage Vault Door, both having a Remote Unlocking Activation Mechanism. The Storage Door has an Adjustable Shelf."

TECHNICAL FIELD

The present invention relates to mailboxes and particularly to theft preventative mailboxes having multiple access doors and automatic locking mechanisms and card key, FOB and/or radio frequency ID unlocking activation mechanisms.

BACKGROUND OF THE INVENTION

The information explosion, aided by easily obtainable credit, has led to a dramatic increase in identity theft. Identity theft is a crime that feeds on the inability of consumers to control who has access to sensitive information and how it is safeguarded. According to the Identity Theft Center, identity theft remains the primary concern among consumers contacting the Federal Trade Commission. According to two (2) studies done in July 2003 by Gartner Research and Harris Interactive, approximately 7 million people became victims of identity theft in the prior 12 months, equal to 19,178 victims per day, 799 victims per hour, 13.3 victims per minute. The incidence of victimization increased 11 to 20% between 2001 and 2002 and 80% between 2002 and 2003 according to the Harris Interactive survey. This same study found that 91% of respondents do not see an "end to the tunnel" and expect a heavy increase in victimization. 49% also stated that they do not feel they know how to adequately protect themselves from this crime. Victims currently spend an average of 600 hours recovering from identity theft, often over a period of years. In 2002, the average was 175 hours of time, representing an increase of about 2470%. Based on 600 hours times the indicated victim wages, this equals nearly $16,000 in lost potential or realized income. While victims are finding out about the crime more quickly, it is taking much longer to clear their records and recover from the crime. Even after the thief stops using the information, victims struggle with the impact of identity theft. Effects of being a victim include increased insurance or credit card fees, inability to find a job, higher interest rates and battling collection agencies and issuers who refuse to clear records despite substantiating evidence of the crime. This effect may continue for more than 10 years after the crime was first discovered. Approximately 85% of victims found out about the crime due to an adverse situation such as denied credit or employment, notification by police or collection agencies, receipt of credit cards or bills never ordered and the like. Only 15% found out through a positive action taken by a business group that verified a submitted application or a reported change of address. The easiest way that thieves have access to personal identification such as pre-approved credit card applications is through theft of mail from unlocked mailboxes.

Module D of the United States Postal Service Domestic Mail Manual sets forth the requirements for customer deposit of mail and basic information on how the Postal Service collects and delivers mail. Information about post office boxes is included in this module. Module D041 describes the standards for letterboxes or other receptacles for the deposit or receipt of mail. It also contains the standards for curbside mailboxes. Manufacturers of all mailboxes designed and made to be erected at the edge of a roadway or curbside of a street and to be served by a carrier from a vehicle on any city route, rural route, or highway contract route must be approved under USPS Standard 7, Mailboxes, City and Rural Curbside. Conventional mailboxes with a lock must have a slot that is large enough to accommodate the customer's normal daily mail volume as the USPS currently neither opens a locked box nor accepts a key for this purpose.

The prior art is well documented with varied examples of mailbox storage and mailbox theft preventative assemblies. The objective in each of these instances is to safeguard the mail from the time the mail delivery person deposits the mail until the time addressee has time to collect the mail.

None of the conventional mailbox storage and mailbox preventive assemblies allow for a normal receptacle opening or front mailbox door that can be locked and remotely unlocked. If such a mailbox were available, both incoming and outgoing mail could be safeguarded. What is desired is a theft preventative mailbox having multiple access doors and an internal lower compartment having a shelf, the doors of which can be unlocked and locked with a minimum of effort on behalf of the postal employee and the addressee. It is an objective of the present invention that such a mailbox would be accepted by the USPS in order to combat the rise in identification theft.

SUMMARY OF THE INVENTION

In a first embodiment of the present invention, a curbside mailbox with an upper compartment, in the nature of an upper compartment, having a front access door and a rear access door each having a locking mechanism and an unlocking mechanism, a lower compartment in the nature of a storage vault or secure lock box, the lower compartment having a rear access door with a locking and an unlocking mechanism, at least one trap door providing ingress from the upper compartment into the lower compartment, the at least one trap door being opened and closed using a timing mechanism.

In a second embodiment of the present invention, a curbside mailbox similar to the first embodiment is provided, but further including an adjustable shelf within the lower compartment.

In a third embodiment of the present invention, a curbside mailbox similar to the first or second embodiment, wherein the unlocking mechanism of each of the front access door, upper rear access door, lower rear access door and trap door(s) is one selected from the group consisting of a magnetic locking mechanism, mechanical locking mechanism or electromechanical locking mechanism.

In a fourth embodiment of the present invention, a curbside mailbox similar to the third embodiment, having an unlocking mechanism that is remotely activated using a far field communication channel, such as a wireless radio frequency (RF) or Hall effect transmitter.

In a fifth embodiment of the present invention, a curbside mailbox similar to the third embodiment, having an unlocking mechanism that is remotely activated using a near field communication channel, such as a FOB, RF identification (RFID) or card key system.

Each embodiment described herein has advantages over the conventional secure and unsecured mailboxes, the primary advantage being the ability to have a standard size mailbox in which both incoming and outgoing mail can be secured. These and many other advantages related to the present invention will become apparent to persons skilled in the relevant arts through careful reading of the disclosure and claims presented herein.

BRIEF DESCRIPTION OF THE DRAWINGS

For a better understanding of the present invention including the features, advantages and specific embodiments, reference is made to the following detailed description along with accompanying drawings in which.

References in the detailed description correspond to like references in the Figures unless otherwise noted. Like numerals refer to like parts throughout the various Figures. Descriptive and directional terms such as top, bottom, left, right, first, second, refer to the drawings themselves as laid out on the paper and not to physical limitations of the invention unless specifically noted.

DETAILED DESCRIPTION OF PREFERRED EMBODIMENTS

While the making and using of various embodiments of the present invention are discussed in detail below, it should be appreciated that the present invention provides many applicable inventive concepts which can be embodied in a wide variety of specific contexts. Some features of embodiments shown and discussed are simplified or exaggerated for illustrating the principles of the invention.

Figure 1:
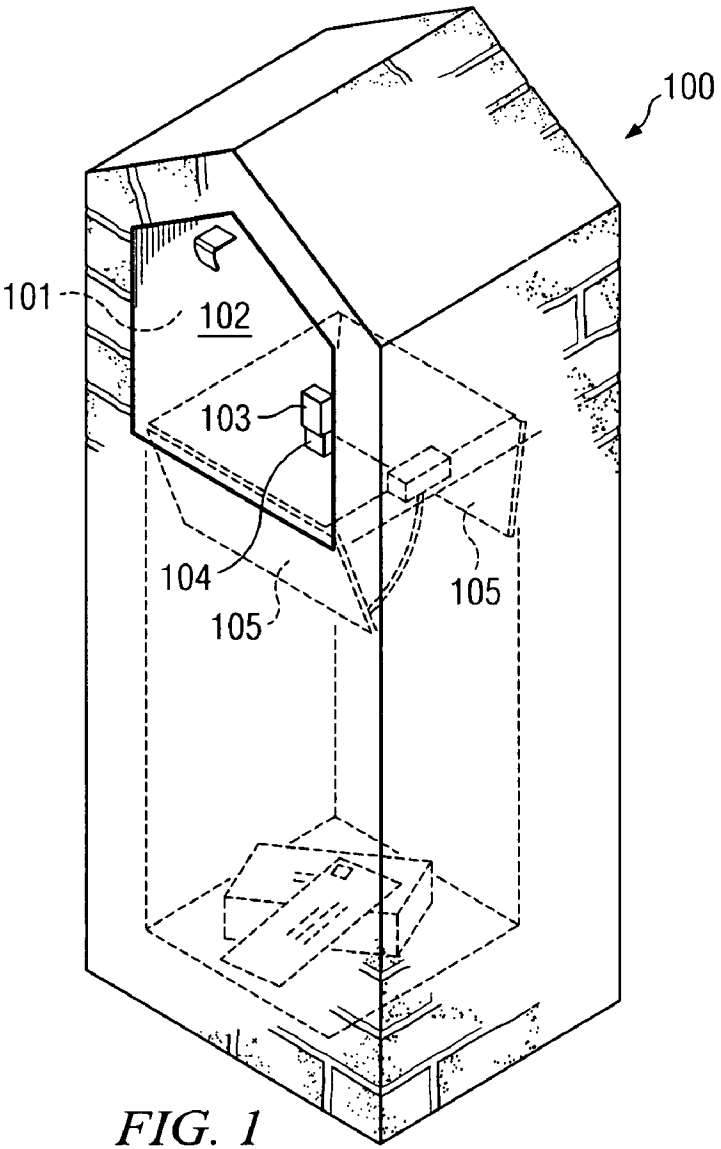
FIG. 1 is a front, side view of a mailbox of the present invention.
Figure 4:
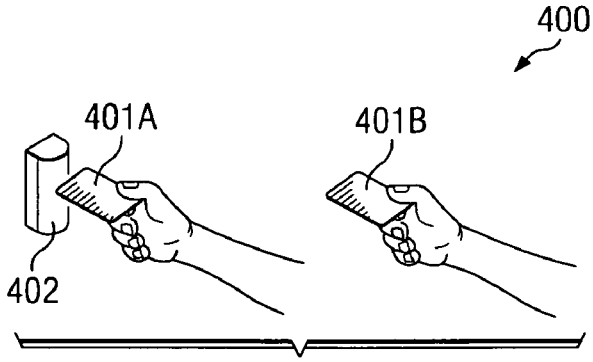
FIG. 4 is a view of a card key locking and unlocking activation system.
Figure 5:
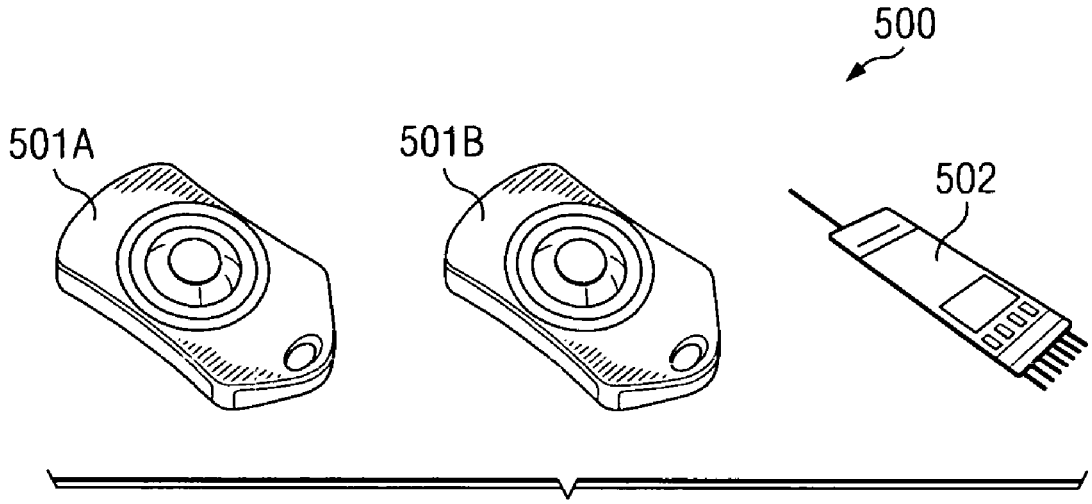
FIG. 5 is a view of a FOB locking and unlocking activation system.
Figure 6:
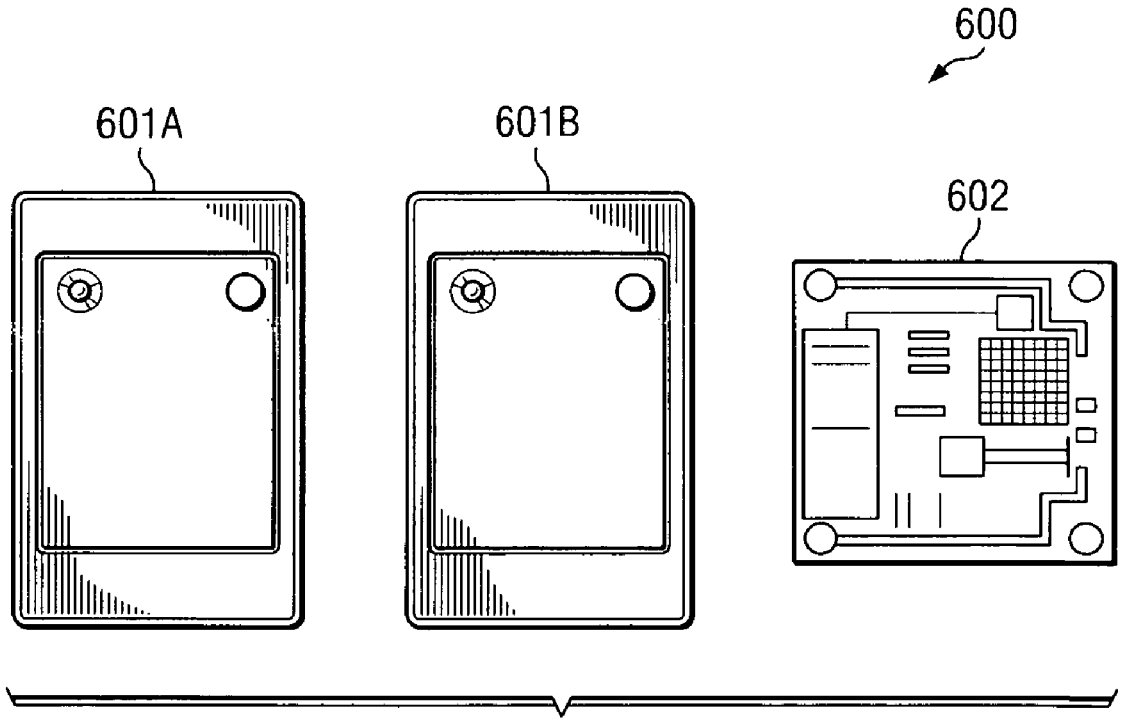
FIG. 6 is a view of an RFID locking and unlocking activation system.

Referring now to FIG. 1, the secure mailbox 100 of the present invention comprises at least an upper compartment 101 having a plurality of sides, including an upper top side, upper left side and upper right side, forming the enclosed upper compartment 101, a front access door 102 hinge-ably coupled to the front of the upper compartment 101 along a front edge of a side with a hinge means, a first locking and unlocking mechanism 103 being adapted to lock the front access door 102 to the upper compartment 101 and a first unlocking activation mechanism 104 coupled to the first locking and unlocking mechanism 103, said first unlocking activation mechanism 104 comprised of any of a card key system 400, a FOB system 500 or an RFID system 600, as seen in FIGS. 4, 5 and 6. The secure mailbox compartments can be made of a resilient material such as heavy duty plastic or galvanized steel, and then the encased in an outer material such as stucco, brick and the like. The first locking and unlocking mechanism 103 is adapted to be unlocked using a key or remotely using the first unlocking activation mechanism 104, and once the front access door 102 is closed, the first locking and unlocking mechanism 103 is adapted to automatically lock the front access door 102 to the enclosed upper compartment 101. The hinge means can include, but is not limited to, a continuous hinge which run the entire length of the mailbox door (also known as a piano hinge), a concealed hinge, or a flush hinge.

Figure 2:
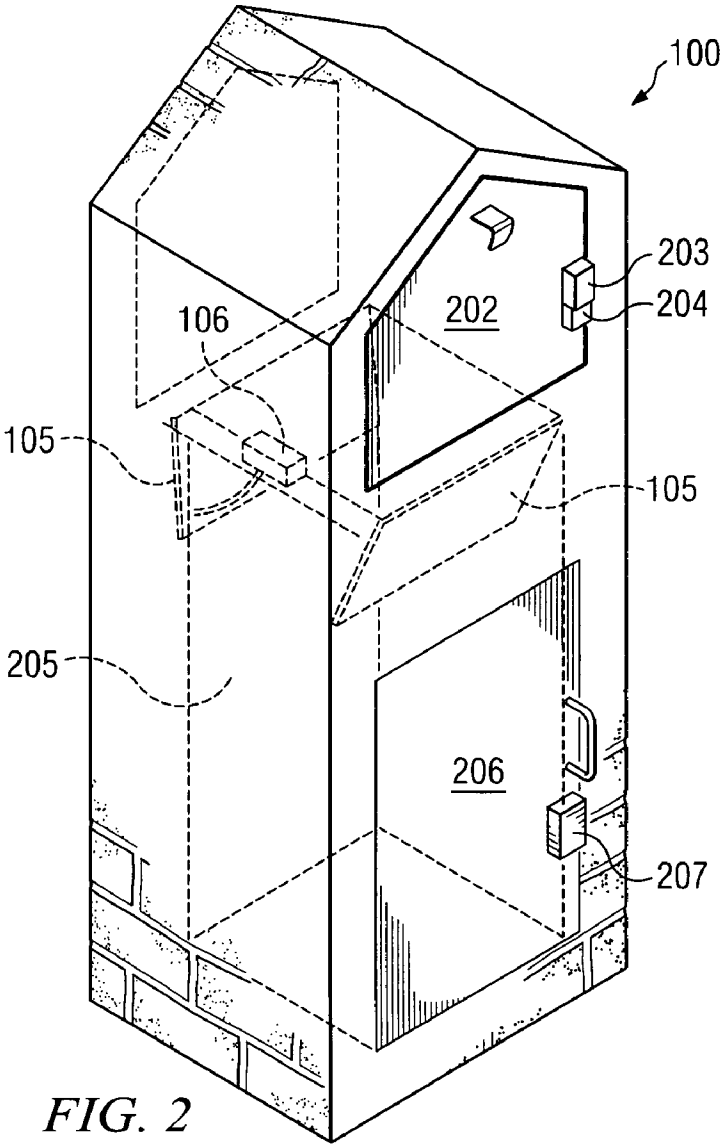
FIG. 2 is a rear, side view of the curbside mailbox of the present invention.

Referring now to FIG. 2, the upper compartment 101 has an upper rear access door 202 hinge-ably coupled to the rear edge of a side of the upper compartment 101 with a hinge means, a second locking and unlocking mechanism 203 being adapted to lock the upper rear access door 202 to the upper compartment 101 and a second unlocking activation mechanism 204 coupled to the second locking and unlocking mechanism 203, said second unlocking activation mechanism 204 comprised of either a card key system 400, a FOB system 500 or an RFID system 600, as seen in FIGS. 4, 5 and 6. The second locking and unlocking mechanism 203 is adapted to be unlocked using a key or remotely using the second unlocking activation mechanism 204, and once the upper rear access door 202 is closed, the second locking and unlocking mechanism 203 is adapted to automatically lock the upper rear access door 202 to the enclosed upper compartment 101.

Further referring to FIG. 2, the secure mailbox 100 of the present invention further comprises at least a lower compartment 205 having a plurality of sides, including a lower left side, lower right side and lower bottom side, forming the enclosed lower compartment 205, a lower rear access door 206 hinge-ably coupled to the rear of the lower compartment 205 with a hinge means, a third locking and unlocking mechanism 207 being adapted to lock the lower rear access door 206 to the lower compartment 205 and a third unlocking activation mechanism 207 coupled to the third locking and unlocking mechanism 207, said third unlocking activation mechanism 207 comprised of either a card key system 400, a FOB system 500 or an RFID system 600, as seen in FIGS. 4, 5 and 6. The third locking and unlocking mechanism 207 is adapted to be unlocked using a key or remotely using the unlocking activation mechanism 104, and once the lower rear access door 206 is closed, the third locking and unlocking mechanism 207 is adapted to automatically lock.

The first, second and third locking and unlocking mechanism can each or all comprise any variety of locking assemblies, including, but not limited to a latch and hook mechanism, a spring loaded mechanism, an electro-mechanical mechanism or a magnetic locking mechanism.

Figure 3:
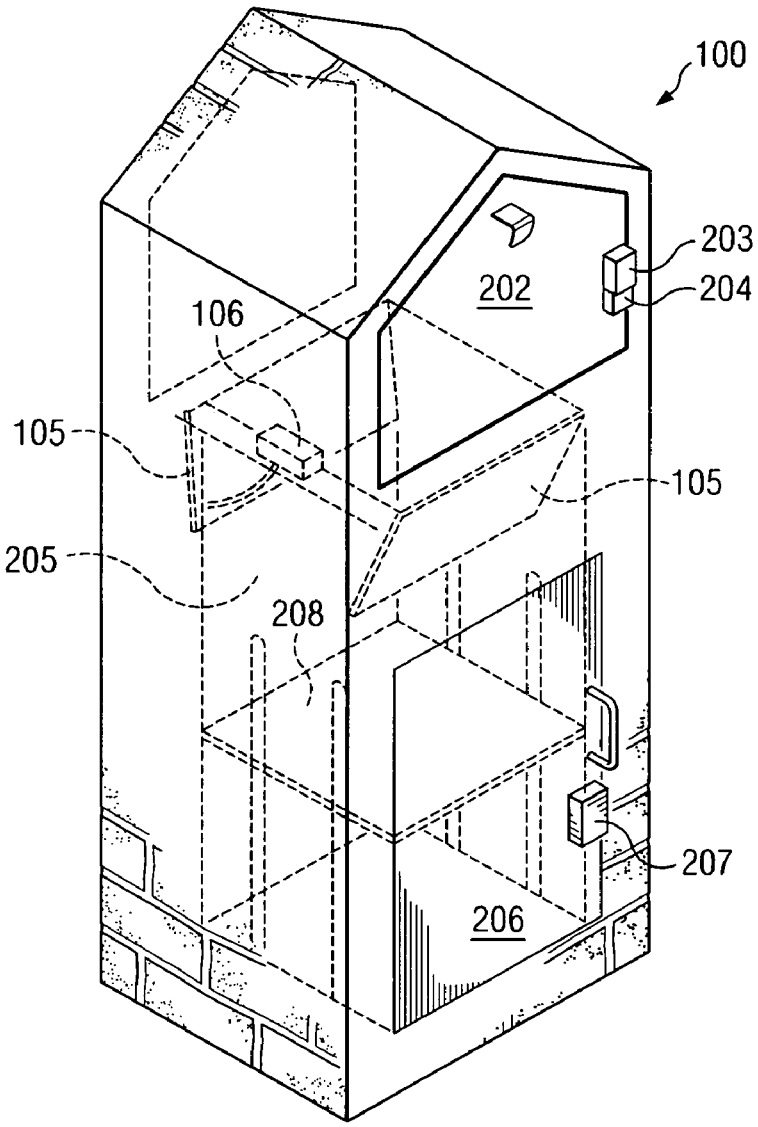
FIG. 3 is a rear, side view of the curbside mailbox of the present invention showing the adjustable rear shelf located therein.

The lower compartment 205 of the present invention acts as a secure drop box having the at least one trap door 105, and as seen in FIGS. 1, 2 and 3, preferably 2 trap doors which, in a closed position, form the floor of the upper compartment 101. When activated, the at least one trap door 105 is released and opens, as seen in FIGS. 1, 2 and 3, allowing any material placed in the upper compartment 101, such as by a postal worker or courier, to drop into the lower compartment 205. As seen in FIGS. 1, 2 and 3, a first trap door 105 is hinge-ably coupled to a front side interior wall between the upper compartment 101 and lower compartment 205 with a hinge means and a second trap door 105 is hinge-ably coupled with a hinge means to a rear side interior wall between the upper compartment 101 and lower compartment 205. The trap door(s) 105 are adapted to rotatably open and allow packages or other items in the upper compartment 101 to fall into the lower compartment 205 when the trap door(s) 105 are released.

The lower compartment 205 is dimensioned to store several days of mail or packages. Thus, it eliminates the need to have the post office or courier hold an addressee's mail or packages while the addressee is away from home. The lower compartment 205 is also dimensioned to accommodate small to medium sized packages thus eliminating the need for the postal employee to bring such packages to an addressee's front access door. As seen in FIG. 3, a shelf 208 having an area and dimensions slightly smaller than that of the floor of the lower compartment 205 can be inserted into the lower compartment 205 to change the volume of the lower compartment 205. The shelf 208 can be included as part of an adjustable shelf system having racks that receive clips or shelf supports, the racks being coupled, e.g., to the side walls of the lower compartment 205.

The use of a lower compartment 205 further reduces the possibility of theft of a package which would otherwise have to be left at the door when the addressee is not at home. The present invention also overcomes the need for the postal employee to return the package to the post office, eliminating the requirement of writing a notice to the addressee to retrieve the package.

The at least one trap door 105 is opened and closed using trap door mechanism 106, which is operable in a variety of ways. The trap door mechanism 106 holds the at least one trap door 105 in a default closed position so that outgoing mail can be placed into the upper compartment 101 at any time. Alternatively, the trap door mechanism 106 can have the trap door(s) 105 in the default open position, with the trap door(s) 105 movable to the closed position by the addressee if the addressee desires to place outgoing mail in the upper compartment 101. In either case, the trap door(s) 105 are adaptable to retain outgoing mail in the upper compartment 101 and permit incoming mail to eventually fall into the lower compartment 205. Although a two trap door mechanism is described herein and illustrated in FIGS. 1, 2 and 3, there are a variety of trap door mechanisms that can be used in the various embodiments of the present invention, all of which are covered by the present invention. The trap door(s) 105 can be comprised of a single door or it can be comprised of multiple trap doors, such as two halves that open in the center, such trap door(s) 105 and being hinge-ably coupled proximate the top of the lower compartment 206.

A first trap door mechanism 106 can include a sensing mechanism that is coupled to the front access door 102 and a release mechanism coupled to the at least one trap door 105 such that when the sensing mechanism senses that the front access door 102 has been opened and closed, it activates the release mechanism so as to release the at least one trap door 105 and cause the mail in the upper compartment 101 to drop into the lower compartment 205. The release mechanism further includes a timer and a retract mechanism adapted to retract the at least one trap door 105 back into the closed position after a certain time has elapsed. The default position of the at least one trap door 105 is the closed position. When the postal employee opens the front access door 102 and inserts any mail into the upper compartment 101 and closes the front access door 102, the release mechanism causes the trap door(s) to open causing the incoming mail to drop into the lower compartment 202. The mechanical or electronic time delay mechanism is then engaged such that after the mail is dropped into the lower compartment 202 and the at least one trap door 105 automatically closes after a predetermined amount of time. When the postal employee closes the front access door 102, the locking and unlocking mechanism 103 automatically locks.

The first, second and third unlocking activation mechanisms can each or all be remotely activated using a near field or far field means. A near field means includes a card key system. As seen in FIG. 4, the unlocking activation mechanism can be comprised of a card key system 400 having a master coded card 401A, a subordinate card 401B retained by the addressee and a card reader 402, the card reader 402 being located at the mailbox and being coupled to at least one of the locking and unlocking mechanisms. The card reader 402 would have a power source which can be the AC mains, a non-rechargeable or rechargeable DC battery source or a solar power source which is operable to power the card reader 402 directly or to recharge the rechargeable batteries. Card key systems can comprise a variety of technologies, such as contact, contactless (proximity), passive, active, magnetic, electronic, sonar and optical. Each of such implementation technologies is included within the purview of this invention.

Most access cards used in card key systems and which are based on proximity, in contrast to contact, are passive. Passive technology implies there is no battery or power source required in the card. The proximity reader which can be located at the mailbox constantly transmits a low level fixed RF signal that transmits energy to the card. When the card 401A, 401B is held at a certain distance from the reader 402, the RF signal is absorbed by a small coil inside the card 401A, 401B and powers the card's chip which contains a unique identification code or a look up table of codes which uniquely identifies the mailbox. Once powered, the card 401A, 401B transmits the code to the card reader 402. Once a correct identification is made, the card key system can activate the unlocking mechanism. Advantages of proximity reading over other technologies include no moving parts, no mechanical wear, no slots and no read heads to maintain. The card reader 402 can be concealed inside the mailbox or and adjacent special enclosures. The encoded cards 401A, 401B can usually be read through most nonmetallic materials. Card and reader orientation is not critical to operation of this implementation. Reading ranges depend primarily on the reader. The larger the reading range, the larger the reader's concealed antenna and hence, the size of the reader 402. There are a variety of proximity readers designed for different environments including vandal-resistant mounts.

Active proximity technology implies there is a battery within the card 401A, 401B. Because the card 401A, 401B uses internal power, the range is greatly expanded from 3 to 15 feet in contrast to 1 to 5 inches with the passive card. The RF signal is low level, usually less than one milliwatt but the frequency used is much higher. With an active card reader system, orientation of the card and reader become important. Active technology is useful where a hands-free (as opposed to contact-less) data exchange is required. Read range is adjustable between 3 to 15 feet. Active cards are generally thicker (⅕ inch) as a result of the replaceable battery requirement. The postal employee would possess master card 401A that is operable to open the mailbox front door on all mailboxes along a route whereas the addressee would possess card 401B that is operable to open only their own mailbox front access door 102 and/or upper or lower rear access door 202, 206, as described in more detail herein.

In operation, the addressee inserts their uniquely encoded subordinate card 401B into a slot, or places it in proximity to the card reader 402, to open the rear access door 202 and places the outgoing mail in the upper compartment 101. By closing the upper rear access door 202, the locking and unlocking mechanism 203 automatically locks the upper rear access door 202. The postal employee subsequently inserts a master card 401A in a card key slot or waves a master card 401A proximate to a reader near the front access door 102. The front access door 102 will then be released for the postal employee to open and collect the outgoing mail. The card key reader or slot 402 preferably is in a weather resistant housing.

A further embodiment of the present invention is a curbside mailbox with at least one unlocking activation mechanism that is activated using an electronic key fob (FOB) system. As seen in FIG. 5, the FOB system 500 has a master FOB transmitter 501A, and a subordinate FOB transmitter 501B retained by the addressee, either FOB transmitter being in a wand form factor or key chain form factor and a FOB receiver 502 coupled to the applicable locking and unlocking mechanism located at the mailbox 100. The FOB receiver 502 can be powered by a power source which can be an AC mains, a non-rechargeable or rechargeable DC battery source or a solar power source to power the FOB receiver 502 directly or to recharge the rechargeable batteries. The FOB transmitters 501A, 501B can be similarly powered. FOB transmitters 501A, 501B and corresponding FOB receiver 502 are conventionally available with a variety of functionalities and form factors. For purposes of this invention, a one function transmitter can be used for the remote control and command application. Typical compact keychain remotes are capable of transmission ranges up to 75 feet. The transmission from the FOB transmitters 501A, 501B can be decoded using a standard decoder integrated circuit, microcontroller, function module or receiver/decoder. Such FOB systems provide for selectable addressing to provide security and allows the creation of distinct transmitter/receiver relationships or one transmitter to many receiver relationships. In this manner, a single, secure master FOB transmitter 501A used by the postal service can be used to activate a number of FOB receivers 502, for example, along a route and each subordinate FOB transmitter 501B is operable only to open the addressee's specific mailbox. Such a unit can operate from a single 3-volt lithium cell. In a single function FOB system, the FOB receiver 502 can be a 7 pin module that plugs into a solderless bread board. The FOB transmitters 501A, 501B can have a single button, the FOB receiver 502 having a single output. While the button on the FOB transmitter 501A, 501B is pressed, the corresponding output goes high for the same duration of time, thus releasing the applicable locking and unlocking mechanism so as to allow access to the upper compartment 101 of the mailbox 100 of the present invention. The addressee would use a subordinate FOB transmitter 501B that is operable only to open their own front access door 102 and/or is operable only to open their own rear lower compartment door 206. One skilled in the art would appreciate that a variety of FOB systems can be used to implement this invention and each of such FOB systems are included within the purview of this invention.

In operation, the addressee waves or otherwise activate their subordinate FOB transmitter 501B in the form factor of a key chain FOB or wand in front of a receiver pad antenna to open the upper rear access door 202 and will place outgoing mail inside. By closing the upper rear access door 202, the locking and unlocking mechanism 203 will automatically lock the upper rear access door 202. Subsequently, a postal employee can wave or otherwise activate the master FOB transmitter 501A or wand in front of the receiver pad antenna, thus activating the locking and unlocking mechanism 103 and releasing the front access door 102. The postal employee can then open and collect the outgoing mail from the upper compartment 101. The postal employee can then insert any new mail in the upper compartment 101 and close the front access door 102. Once the front access door 102 has been closed, trap door mechanism 106 can release the at least one trap door(s) 105 so that incoming mail is dropped into the lower compartment 205. After a certain time delay, the at least one trap door 105 returns to the closed position, leaving the incoming mail in the lower compartment 205. The addressee would then retrieve the mail from the lower compartment 205 by unlocking and opening the lower rear access door 206. The FOB receiver 502 is preferably located within a weather resistant housing.

A further embodiment of the present invention is a curbside mailbox with at least one unlocking activation mechanism that is activated using a using an RFID system. As seen in FIG. 6, the RFID system 600 has a master RFID transceiver 601A and a subordinate RFID transceiver 601B, each located remotely from the mailbox and an RFID module 602 located at the mailbox. Each RFID transceiver 601A, 601B can be powered by a power source which can be the AC mains, a non-rechargeable or rechargeable DC battery source or a solar power source to power the RFID transceivers 601A, 601B directly or to recharge the rechargeable batteries. RFID, which is an abbreviation for radio frequency identification, is a generic term that is used to describe a system that transmits the identity, in the form of a unique serial number, of an object wirelessly, using radio waves. In the case of the present invention, the object is each unique mailbox, or more specifically, the identification of the RFID module 602 within each specific mailbox. RFID is considered an automatic identification technology. RFID is designed to enable readers to capture data on objects and transmit it to a system without requiring the active involvement of a person.

A typical RFID module 602 consists of a microchip attached to a radio antenna mounted on a substrate. The chip can store as much as 2 kilobytes or more of data. For example, information about the mailbox can be written to the RFID module 602. To identify the mailbox to the postal employee, the postal employee must retrieve the data stored on the RFID module 602 using an RFID module reader, referred to as the master RFID transceiver 601A. Such a master RFID transceiver 601A can be portable or can be installed in a postal vehicle. A typical RFID transceiver is a device that has one or more antennas that emit radio waves and receive signals back from the RFID module 602. The RFID transceiver then passes the information in digital form to a CPU and memory having a look-up table. An acknowledgement from the CPU and memory that the postal employee can access the upper compartment 101 is sent back to the RFID module 602 thus unlocking the locking and unlocking mechanism 103. The postal employee's master RFID transceiver 601A and corresponding CPU and memory could be configured, through software programming or hardwiring, to allow access to any number of mailboxes, such as along a specific mail route. The addressee would likewise have a subordinate RFID transceiver 601B that is operable only to open their specific front access door 102 and/or is operable to open the rear lower compartment door 206.

In any of the embodiments of the present invention which incorporate a secure lower compartment, the secure lower compartment is not accessible without a specifically mechanical key, encoded key, card key, override key, FOB transmitter or RFID transceiver. When the lower rear access door 206 is closed, the third locking and unlocking mechanism 207 is adapted to automatically lock the lower rear access door 204. Further, an embodiment of the present invention includes a signaling means adapted to inform the owner that mail has been inserted in the secure mailbox. This signaling means can include a light, such as an LED, located proximate to the box or away from it, or a wireless signal sent to a receiver within the home of the mailbox owner coupled to a visible or audible transducer.

Each of the embodiments of the present invention can have a variety of dimensions. A preferred set of dimensions are as follows: overall for the entire mailbox, including outside enclosure made of brick, stucco and the like: 50" high×24" wide×24" deep. The upper compartment and lower compartment can have dimensions of 40" high×20" wide×20" deep.

The embodiment that uses two(2) trap doors side by side that open at the middle, each can be dimensioned as 20" wide×10" long.

In one aspect of any of the embodiments, the post office can retain security responsibility for controlling the master codes or identifications used in the card key system, FOB system or RFID system. Different master codes can be assigned to individual routes and can be easily changed if security is compromised through the loss of code keys or any device that is used to activate a locking and unlocking mechanism. Such a system of codes (groups or subgroups of which can be identified by different colors) can be used for specific routes. In operation, each post office employee could have a master card key, FOB transmitter or RFID transceiver configured specifically for that route. The codes would only work with that particular route and would not correspond to mailboxes outside of that route.

Each of the embodiments of the present invention could include a device or module of sending a signal to the addressee or to a geographical location to indicate that mail has been left in the secure mailbox. This can be accomplished with a programmable control card, ID lights and an actuator.

There are numerous advantages of the present invention for the addressee. The present invention saves money and time for addressees who would otherwise travel to a post office to retrieve mail that had been placed on hold or who, for security reasons, must travel to postal drop boxes located at, for example, strip shopping malls to deposit outgoing mail. It also avoids the burden of having to request that a neighbor or acquaintance pick up mail while the addressee is away from home.

The embodiments shown and described above are only exemplary. Even though numerous characteristics and advantages of the present invention have been set forth in the foregoing description together with details of the method of the invention, the disclosure is illustrative only and changes may be made within the principles of the invention to the full extent indicated by the broad general meaning of the terms used in the attached claims.

I claim:

1. A secure mailbox, comprising:

an enclosed upper compartment having a plurality of sides forming said enclosed upper compartment:

a front access door hinge-ably coupled along a front edge of one of said sides of said upper compartment;

a first locking and unlocking mechanism being adapted to lock the front access door to the upper compartment when the front access door is in a closed position:

a first unlocking activation mechanism coupled to the first locking and unlocking mechanism adapted to unlock the front access door:

an upper rear access door hinge-ably connected along a rear edge of another of said sides of the upper compartment;

a second locking and unlocking mechanism being adapted to lock the upper rear access door to said upper compartment when the rear access door is in a closed position;

a second unlocking activation mechanism coupled to the second locking and unlocking mechanism adapted to unlock the upper rear access door;

an enclosed lower compartment having a plurality of sides forming said enclosed lower compartment, said lower compartment being below the upper compartment, there being at least one trap door allowing ingress from the upper compartment into the lower compartment further comprising a trap door mechanism, the at least one trap door being opened and closed using said trap door mechanism;

said lower compartment having a lower access door hinge-ably connected along an edge of one of said sides of the lower compartment;

a third locking and unlocking mechanism coupling the lower access door to the lower compartment, the third locking and unlocking mechanism having an unlocking activation mechanism;

at least one remote activation means coupled to at least one of said first, second and third unlocking activation mechanisms, said at least one first, second and third unlocking activation means being remotely activated using the at least one remote activation means;

wherein the remote activation means comprises a card key system having at least one master card encoded with a plurality of unique identifiers and at least one subordinate card encoded with a subset of the unique identifiers; and a card reader located proximate to the mailbox and coupled to at least one of the locking and unlocking mechanisms, said card reader operable to unlock the door coupled to the locking and unlocking mechanism upon receiving a signal from the master encoded card or subordinate card.

2. The secure mailbox of claim 1, wherein the card key reader is one selected from the group consisting of a contact reader and a proximity reader.

3. The secure mailbox of claim 1, wherein the master card encoded with a plurality of unique identifiers is adapted to activate unlocking mechanisms coupled to the at least one of the first, second and third unlocking activation means of multiple mailboxes.

4. The secure mailbox of claim 1, wherein said card reader is powered by a power source consisting of one from the group of AC power, rechargeable DC battery, non-rechargeable DC battery or DC solar.

5. A secure mailbox, comprising:

an enclosed upper compartment having a plurality of sides forming said enclosed upper compartment;

a front access door hinge-ably coupled along a front edge of one of said sides of said upper compartment;

a first locking and unlocking mechanism being adapted to lock the front access door to the upper compartment when the front access door is in a closed position;

a first unlocking activation mechanism coupled to the first locking and unlocking mechanism adapted to unlock the front access door;

an upper rear access door hinge-ably connected along a rear edge of another of said sides of the upper compartment;

a second locking and unlocking mechanism being adapted to lock the upper rear access door to said upper compartment when the rear access door is in a closed position;

a second unlocking activation mechanism coupled to the second locking and unlocking mechanism adapted to unlock the upper rear access door;

an enclosed lower compartment having a plurality of sides forming said enclosed lower compartment, said lower compartment being below the upper compartment, there being at least one trap door allowing ingress from the upper compartment into the lower compartment further comprising a trap door mechanism, the at least one trap door being opened and closed using said trap door mechanism;

said lower compartment having a lower access door hinge-ably connected along an edge of one of said sides of the lower compartment;

a third locking and unlocking mechanism coupling the lower access door to the lower compartment, the third locking and unlocking mechanism having an unlocking activation mechanism;

at least one remote activation means coupled to at least one of said first, second and third unlocking activation mechanisms, said at least one first, second and third unlocking activation means being remotely activated using the at least one remote activation means;

wherein the at least one remote activation means comprises a FOB system, wherein the FOB system further comprises at least one master RF transmitter adapted to output one of a plurality of unique digital signals and at least one subordinate RF transmitter adapted to output a subset of such unique digital signals;

an RF receiver adapted to receive a subset of said unique digital signals;

said RF receiver located proximate to the mailbox and coupled to the at least one the locking and unlocking mechanism, said RF receiver operable to unlock at least one of the mailbox doors upon receiving a specific digital signal from the master RF transmitter or subordinate RF transmitter.

6. The secure mailbox of claim 5, wherein the master FOB transmitter is operable to activate at least one unlocking mechanisms on multiple mailboxes.

7. The secure mailbox of claim 5, wherein said RF receiver is powered by a power source consisting of one from the group of AC power, battery, solar or wind.

8. The secure mailbox of claim 5 wherein the master RF transmitter and subordinate RF transmitter are in the form factor from the group consisting of a wand and key FOB.

9. A secure mailbox, comprising:

an upper compartment having a plurality of sides forming said enclosed upper compartment;

a front access door hinge-ably coupled along a front edge of one of said sides of said upper compartment;

a first locking and unlocking mechanism being adapted to lock the front access door to the upper compartment when the front access door is in a closed position;

a first unlocking activation mechanism coupled to the first locking and unlocking mechanism adapted to unlock the front access door;

an upper rear access door hinge-ably connected along a rear edge of another of said sides of the upper compartment;

a second locking and unlocking mechanism being adapted to lock the upper rear access door to said upper compartment when the rear access door is in a closed position;

a second unlocking activation mechanism coupled to the second locking and unlocking mechanism adapted to unlock the upper rear access door;

an enclosed lower compartment having a plurality of sides forming said enclosed lower compartment, said lower compartment being below the upper compartment, there being at least one trap door allowing ingress from the upper compartment into the lower compartment further comprising a trap door mechanism, the at least one trap door being opened and closed using said trap door mechanism;

said lower compartment having a lower access door hinge-ably connected along an edge of one of said sides of the lower compartment;

a third locking and unlocking mechanism coupling the lower access door to the lower compartment, the third locking and unlocking mechanism having an unlocking activation mechanism;

at least one remote activation means coupled to at least one of said first, second and third unlocking activation mechanisms, said at least one first, second and third unlocking activation means being remotely activated using the at least one remote activation means;

wherein the at least one remote activation means comprises an RFID system, wherein the RFID system further comprises:

a least one remote master RF transceiver and at least one remote subordinate RF transceiver;

at least one RF module located proximate to a mailbox and coupled to at least one of the locking and unlocking mechanisms;

said master RF transceiver and subordinate RF transceiver operable to interrogate the RF module;

said RF module adapted to return a unique digital identification;

the master RF transceiver operable to compare the unique digital identification to a set of identifications provided in a table;

the subordinate RF transceiver operable to compare the unique digital identification to a unique identification stored in the subordinate RF transceiver; and said RF module operable to unlock at least one mailbox door upon receiving a match acknowledgment signal from either the master RF transceiver or subordinate RF transceiver.

10. The secure mailbox of claim 9, wherein the master RF transceiver is operable to activate unlocking mechanisms on multiple mailboxes.

11. The secure mailbox of claim 9, wherein said RF module is powered by a power source consisting of one from the group of AC power, battery, EM activation (passive) or solar.

* * * * *